US007282313B2

(12) United States Patent
Ohira et al.

(10) Patent No.: US 7,282,313 B2
(45) Date of Patent: Oct. 16, 2007

(54) PREPARATION METHOD OF TONER AND TONER

(75) Inventors: Akira Ohira, Hachioji (JP); Junji Ujihara, Hachioji (JP); Shoichiro Ishibashi, Hachioji (JP); Kentarou Yamawaki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 411 days.

(21) Appl. No.: 10/924,114

(22) Filed: Aug. 23, 2004

(65) Prior Publication Data

US 2005/0089784 A1 Apr. 28, 2005

(30) Foreign Application Priority Data

Aug. 27, 2003 (JP) ..... 2003-302710

(51) Int. Cl.
*G03G 5/00* (2006.01)

(52) U.S. Cl. ..... 430/137.1; 430/137.15

(58) Field of Classification Search ..... 430/137.1, 430/137.15
See application file for complete search history.

(56) References Cited

U.S. PATENT DOCUMENTS 6,818,369 B2 * 11/2004 Sugiura et al. ..... 430/108.1

FOREIGN PATENT DOCUMENTS

| | | |
|---|---|---|
| JP | 2002-49176 | 2/2002 |
| JP | 2002-229265 | 8/2002 |
| JP | 2002-251037 | 9/2002 |

* cited by examiner

*Primary Examiner*—Mark A. Chapman
(74) *Attorney, Agent, or Firm*—Cantor Colburn LLP

(57) ABSTRACT

Disclosed is a production method of an electrophotographic toner, which comprises toner particles comprising a resin and a colorant. The method comprises a step of forming toner particles in an aqueous medium, and processing an aqueous medium containing the toner particles or a component of the toner particles by gas bubbles.

12 Claims, 4 Drawing Sheets

PREPARATION METHOD OF TONER AND TONER

TECHNICAL FIELD

The present invention relates to a method for preparing a toner to be employed for copying machine or printer, a toner and an image forming method employing the toner.

BACKGROUND

Recently, accompanied with the progress in the digital technology, image formation by digital system becomes main stream of the image forming method by electrophotographic system. The digital image forming method is based on the imaging of small dot image of one pixel such as 1200 dpi (dpi is number of the dot per inch or 2.54 cm). Therefore, technique suitable for exactly reproducing a high quality image is demanded.

From such the viewpoint of rising in the image quality, miniaturization of the toner particle is progresses. Hitherto, so called crushed toner is principally employed for Formation of an electrophotographic image, which is prepared by mixing and kneading binder resin and pigment and crushing and classifying the crushed toner powder. However, there is limit to miniaturization of the toner particle and unifying the particle size distribution. Accordingly, sufficient high image quality is difficultly attained in the image employing the crushed toner.

Recently, polymerized toner prepared by suspension polymerization or emulsion polymerization is noted as the means for attaining the miniaturization of the particle and for unifying the size distribution and the shape of the toner.

The polymerization method of the toner include a method in which resin particle and, according to necessity, colorant particles are associated or salted out/fused to prepare toner particles having irregular shape, and a method in which colorant is mixed and dispersed in radical polymerizable monomer and the resultant dispersion is dispersed in a liquid to form oil droplets having a designate diameter and then the oil droplets are subjected to suspension polymerization. Among them, the former polymerization method is preferable for forming the irregular shaped toner. In this polymerization method, a water-soluble polymerization initiator is employed for polymerization. On this occasion, a chain-transfer agent is employed for controlling the molecular weight distribution.

However, volatile components contained in the polymerizable monomer or the chain-transfer agent is difficultly removed completely from the toner particles on the occasion of the production.

The toner containing large amount of the volatile tends to be aggregated and a developer using the aggregated toner tends to cause problems such as that the image quality is degraded on the occasion of the image formation and sufficient quality image cannot be obtained, bad odor occurs on the occasion of fixing by evaporation of the volatile substance and the polymerizable monomer remaining in the toner, and the printed surfaces of image receiving sheets such as paper adhere with together on the occasion of high speed printing on the both sides.

The problems caused by the polymerizable monomer and the chain-transfer agent remaining in the toner are not specifically appeared as an important matter in the crashed toner prepared by melting, kneading and crushing the binder and the colorant. The reason of that is considered that the binder resin to be employed in the crushed toner is previously dried in many cases and the volatile component is removed by heating in the melting and kneading process of the production if the resin contains the volatile substance such as the unreacted polymerizable monomer.

In the polymerized polymer, however, it is considered that the unreacted monomer and the volatile substance can not be completely removed and the above problems are caused by the remaining volatile components since the melting and kneading process is not included in the production processes.

As to such the problems, a method by prescribing the amount of styrene monomer remaining in the toner and a method by prescribing the amount of remaining monomer have been disclosed. However, the problems of the occurrence of bad odor on the occasion of thermal fixing and that of the tacking of the printed surfaces of the image receiving sheets on the occasion of high speed printing on both sides of the sheet can not be solved and the property as the printing method is insufficient (see Patent documents 1 and 2).

Patent document 1: Japanese Patent Publication Open to Public Inspection, hereinafter referred to as Japanese Patent O.P.I. Publication, No. 2002-251037

Patent document 2: Japanese Patent O.P.I. Publication No. 2002-49176

SUMMARY OF THE INVENTION (Problems to be Solved by the Invention)

An object of the invention is to provide a production method of a toner in which the scatter of the charging amount between the lots of the toner is prevented, the storage stability of the toner is excellent, adhesion of the output image receiving paper is prevented, fixing ability of the toner is sufficient and no bad odor occurs on the occasion of thermal fixing, a toner and an image forming method and an image forming apparatus employing the toner.

(Means for Solving the Problems)

A toner production method including a process for forming toner particles in an aqueous medium, wherein the method includes a process for treating a toner composition or a toner particle dispersed in an aqueous medium by a bubble.

The gas constituting the bubble is preferably air or gas containing ozone.

It is preferable that the method further has a process for irradiating the aqueous dispersion of the toner composition or the toner particle by light.

The process for treating by the bubble is preferably carried out in a stirring tank. The stirring tank is preferably a tank having a stirring wing capable of stirring and a nozzle emitting gas for forming the bubble under the liquid surface in the stirring tank.

It is preferable that a peak of volatile substance in a head space gas chromatograph is between the peak of n-hexane and that of n-hexadecane and the total area of the peak is from 0.5 to 20 ppm in terms of toluene.

PREFERRED EMBODIMENT TO PRACTICE THE INVENTION

Figure 1:
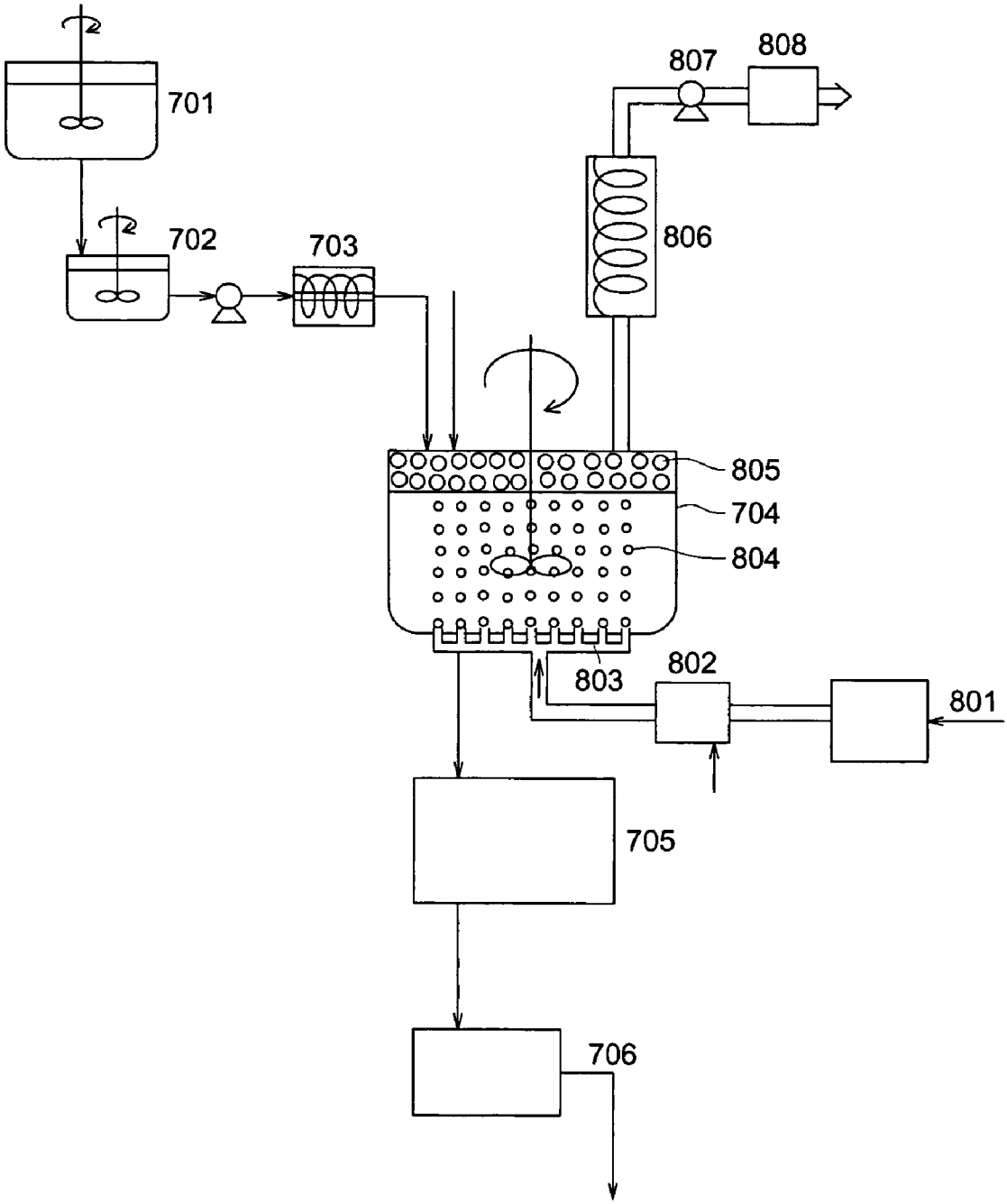
FIG. 1 shows the production flow chart of an example of a production method of toner particle preferably employed in the invention, in which gas containing ozone is employing for the bubble treatment.

According to the found by the inventors, it is important to control the entire amount of the volatile substance contained in the toner. As a result of investigation on the adhering substance on the carrier in a double-component developer and that on a developer carrying member and a developer layer regulating member, it is understood that the toner containing a large amount of the volatile substance adheres to them. Namely, it is understood that the volatile substance remaining in the toner causes coagulation of the toner and bad odor occurrence on the occasion of thermally fixing the toner on the image receiving paper. It is further found that the volatile substance dissolves the low molecular weight binder resin in the toner and the dissolved resin adheres to the carrier of the developer, the developer conveying member and the developer layer regulating member so as to accelerate the degradation of the image and adherence of the output image receiving paper sheets with together so as to difficultly true up the edges of the sheets on the occasion of high speed printing on both sides of the paper. For inhibiting such the problem, a method to raise the molecular weight of the binder resin can be applied. However, a problem is posed in such the method that the fixing ability is lowered since the softening point of the toner is raised.

As a result of the investigation, it is found that the object of the invention can be attain by making the total amount of the volatile substances to within the range of from 0.5 to 20 ppm, and preferably from 1.0 to 10 ppm.

Examples of the volatile substance include the non-reacted polymerizable polymer, the chain-transfer agent, a by-product of the toner production, and an organic solvent employed for the production.

Examples of the polymerizable monomer are styrene, o-methylstyrene, acrylic acid, methacrylic acid, acrylic acid, ethyl acrylate and butyl acrylate, and those of the crosslinkable monomer are divinylbenzene and poly(ethylene glycol) dimethacrylate.

Examples of the chain-transfer agent are n-octylmercaptan and n-decylmercaptan; those of the by-product of the toner production are butanol, dodecanol, dodecanal, an acrylic ester and benzaldehyde; and those of the organic solvent employed for the production are benzene, xylene, ethylbenzene, ethyl acetate and butyl acetate.

For controlling the total amount of the volatile substances, various methods of to simply heating the toner particles and to prolong the polymerization time and to increase the amount of the polymerization initiator are applicable.

However, these methods are not sufficient and it is found by the inventors that the volatile substances can be removed by decomposing or releasing from the particle surface by the babble treatment in the production process.

The toner particle contains the resin and the colorant, and may further contain a parting agent and a charge controlling agent. In the toner producing method according to the invention, the toner particle is formed in the aqueous medium. A method in which resin particles having smaller diameter than the toner particle diameter and the colorant are coagulated in the aqueous medium and a method in which the monomer containing the colorant is dispersed into the size of the toner particle in the aqueous medium and polymerized to prepare the toner particle are applicable. The colorant may be added in an optional process in the course of the production. The parting agent and the charge controlling agent also may be added in any process.

The gas is introduced to form bubbles in a vessel in which the aqueous dispersion of the formed toner or raw materials thereof, or the toner composition such as the monomer, colorant, parting agent and charge controlling agent are charged, and the dispersion is stirred. The treatment of the dispersion containing the toner particles by the bubbles is particularly effective.

In concrete, the gas is expired from the nozzle arranged under the liquid surface in the stirring tank containing the aqueous dispersion to form the bubbles. The unreacted polymerizable monomer, the chain-transfer agent, a surfactant, the colorant and the parting agent not included into the toner particle and ultra fine particles of toner adhere onto the surface bubbles and can be removed out from the system. The treatment by the bubbles is called as bubbling. Air, oxygen, nitrogen, carbon dioxide and ozone-containing gas are applicable as the gas to be introduced for forming the bubbles. Among them, air is most easily usable and the ozone-containing gas is preferred since it has strong oxidation ability and decomposes the volatile substances.

As the ozone generation apparatus, ones by a silent discharge method, an electric decomposing method and an UV lamp method are all applicable. Among them the apparatus by the silent discharge method is preferable since high concentration ozone can be stably obtained.

Ozone generated from the ozone-containing gas producing apparatus is adjusted to the objective concentration by diluting with a gas such as air, oxygen and nitrogen.

Though the volatile substances can be decomposed in a short duration when the ozone concentration in the gas employed for bubbling is higher, the concentration is selected so that the volatile substance can be decomposed without decomposition of the composition constituting the toner since the toner composition such as the resin component is also decomposed by ozone simultaneously.

In concrete, the concentration is preferably from 0.1 to 40 ppm, and more preferably from 0.3 to 20 ppm.

The bubbling time by the ozone-containing gas is preferably from 30 seconds to 2 hours.

A lot of fine bubble is necessary for the treatment, and bubbles formed by air caught in the liquid by stirring are insufficient.

The amount of the gas necessary for treating the dispersion containing the toner particles or the toner composition is preferably from 2 to 30 $m^3$, and more preferably from 2 to 10 $m^3$, per liter of the dispersion.

Moreover, the dispersion is irradiated by light in the toner production method.

As the light source of the irradiation, one emitting UV rays such as a high pressure mercury lamp is applicable, and a light source emitting UV rays having a peak at 190 to 200 nm is preferable.

The irradiation is preferably performed by the light source provided in the aqueous liquid in the reaction vessel or by circulating the aqueous liquid on the surface of the light source. The light irradiation may be carried out simultaneously, before or after the bubbling treatment.

The gas to be used for the bubbling may be previously irradiated by light.

The time for the light irradiation is preferably from 1 minute to 2 hours.

The preparation of the toner particle in the aqueous medium may be performed by an emulsion association method, a suspension production method, a dispersion polymerization method, and a dissolving suspension method may be applicable for production of the toner in the aqueous medium. They are concretely described later.

The amount of the volatile substances contained in thus obtained toner particles can be measured by a head space gas chromatographic method. The toner is characterized in that the peaks of the volatile substances in the head space chromatograph are between the peak of the n-hexane and that of n-hexadecane and the total area of the peaks of the volatile substances is from 0.5 to 20 ppm in terms of toluene.

At least one of the following items can be satisfied by controlling the amount of the volatile substances measured by the head space gas chromatography: the scatter between the lots of the toner is prevented, the storage stability of the toner is excellent, the adhesion between the output image receiving paper sheets is prevented, the fixing ability of the toner image is excellent and no bad odor occur on the occasion of thermal fixing.

In the invention, the head space method using for determining the volatile remaining in the toner is a method in which the toner is closed in a container capable of being freely opened and closed and heated at a temperature about that same as that at the thermal fixing, and then the gas filled by the volatile components is rapidly injected into the gas chromatography apparatus for measuring the amount of the volatile components and mass spectrographic analysis is performed at the same time.

For measuring the amount of the impurity derived from the resin and a very small amount of additive, a method is well known in which the binder resin or the toner is dissolved in a solvent and injected into the gas chromatographic apparatus. This method is not suited for measuring the total mount of the volatile substance since the peaks of the impurity and the very small quantity of the additive tend to be screened by the peak of the solvent. In the head space method applied in the invention, observation of the entire peaks of the volatile substances is made possible by the use of the gas chromatographic method, and the quantitative analysis of the remaining components with high accuracy can be attained by the application of the analysis utilizing the mass spectrometric method.

The measuring procedure by the head space method is described in detail below.

Measuring Method

1. Sampling

Into a 20 ml vial for head space method, 0.8 g of the sample is taken. The amount of the sample is weighed by 0.01 g (such the accuracy is necessary for calculating the area per unit weight). The vial is sealed by septum using an exclusive crimper.

2. Heating the Sample

The sample is put into a thermostat kept at 170° C. in a standing state and heated for 30 minutes.

3. Introduction of the Sample

The vial is taken out from the thermostat and 1 ml of the sample is immediately injected to the gas chromatography apparatus by a gas-tight syringe.

4. Calculation

In the invention, the substances detected between the peak of n-hexane and that of n-hexadecane are determined as the entire amount of the volatile substances.

For determining the quantity of the polymerizable monomer, a calibration curve is previously prepared using the polymerizable monomer employed for polymerization as the standard substance, and the concentration of each of the components is determined.

5. Apparatus (1) Head Space Condition

Head Space Apparatus

Head Space Sampler, manufactured by Hewlett-Packard Co., Ltd. HP

Temperature Condition

Transfer line: 200° C.

Loop temperature: 200° C.

Sampling amount: 0.8 g/20 ml vial (2) GC/MS Condition

GC: Manufactured by Hewlett-Packard Co., Ltd. HP

MS: Manufactured by Hewlett-Packard Co., Ltd. HP

Column: HP-624 (30 m×0.25 mm)

Oven Temperature: Held at 40° C. for 3 minutes, thereafter heated by 200° C. at a rate of 10° C. spending 16 minutes and then held at 200° C.

Measuring Mode: SIM

In the practical measuring in the invention, pre-measurement is carried out with respect to n-hexane and n-hexadecane as the standard samples according to the foregoing oven temperature program for previously confirming the detecting time of the peaks of these compounds. Thereafter, the measurement on the sample is performed according to the above oven temperature program, and the total area of the peaks of the substances detected between the detecting time of the n-hexane and that of the n-hexadecane is converted by the toluene calibration curve. The peak corresponding to not less than 0.1 ppm in terms of toluene is subjected to the determination. The volatile substances and the polymerizable monomer detected in the above period are determined.

The toner producing method including the treatment by the bubbles is described below.

The dispersion of the toner composition or the aqueous dispersion of toner particles is treated by the bubbles. In concrete, the aqueous dispersion is stirred while injecting gas for forming the bubbles. The resultant toner particles are separated from the liquid by filtration, and then washed and dried.

An external additive is added according to necessity to thus obtained toner particles.

The aqueous medium is a liquid containing not less than 50% of water, which contains, for example, methanol, ethanol, iso-propanol, butanol, 2-methyl-2-butanol, acetone, methyl ethyl ketone, tetrahydrofuran or a mixture of them other than the water. The medium preferably contains a surfactant. For producing the toner, suitable one can be selected from the above.

The dispersion of the toner particles can be produced by various methods, in concrete, an emulsion association method, a suspension polymerization method, a dissolving suspension method and a continuous emulsifying dispersion method are applicable.

In the production method of the toner particle dispersion, resin particles obtained by emulsion polymerization are salted out/fused in the aqueous medium to form the toner particle dispersion such as disclosed in Japanese Patent O.P.I. Publication Nos. 2002-351142, 5-265252, 6-329947 and 9-15904.

In concrete, the resin particles are dispersed in the aqueous medium by employing a emulsifying agent, and then salted out by adding a coagulating agent in a concentration larger than the critical coagulating concentration and simultaneously fused by heating at a temperature higher than the glass transition point of the resin particle to form fused particles while the diameter of the fused particle is gradually grown. A coagulation stopping agent such as a lot of water is added to stop the growing of the particles when the particle diameter is reached at an objective size. The shape of the particle is controlled by making smooth the surface while the dispersion is further heated and stirred to prepare the toner dispersion liquid. A water-miscible solvent such as alcohol may be added together with the coagulating agent.

The amount of the volatile substances can be controlled by the bubbling even when the toner dispersion prepared by any producing method, the toner particle dispersion prepared by the emulsion polymerization method is suitable for the bubble treatment.

For solid liquid separation apparatus, a rotation cylinder type dehydrator and a horizontal belt type dehydrator are applicable, and the rotation cylinder type dehydrator is preferred from the viewpoint of space saving.

FIG. 1 is a flow chart displaying an example of the preferable toner particle producing method. The equipment includes an ozone generation apparatus, and ozone-containing gas is employed for the bubbling treatment.

In FIG. 1, 701 is a reaction vessel, 702 is a stock tank, 703 is a concentrator, 704 is a stirring tank, 705 is a rotation cylinder type dehydrator, 706 is a dryer, 801 is an ozone generator, 802 is an ozone-containing gas preparation apparatus, 803 is a bubbling nozzle, 804 is bubbles, 805 is foam, 806 is a condenser, 807 is a suction apparatus and 808 is a volatile component removing apparatus.

The processes are each described according to the flow of FIG. 1. The toner particle dispersion prepared in the reaction vessel 701 is sent to the stock tank and temporarily stocked. The particle dispersion stocked in the stock tank 702 is concentrated by the concentrator 703 and sent to the stirring tank 704. Volatile substances having a specific gravity smaller than that of water are previously removed in the concentrator 703. In the stirring tank 704, the solid mass of the toner particles formed by the concentration are re-dispersed by adding water so as to prepare toner particle dispersion having a concentration suitable for solid-liquid separation and water-soluble volatile substances are dissolved in the water. After that, ozone-containing gas is expired under liquid surface in the stirring tank 704 through the nozzles 803, the bubbles of the ozone-containing gas 804 surface accompanied with the volatile substances adhering to the toner particle and the components decomposed by the bubbles and removed in a form of the foam 805.

The ozone-containing gas used for the bubbling, gas formed by decomposition of the volatile substances and the bubble accompanying the volatile substances 805 are removed out from the system by the suction apparatus 807 after separating the liquid component by the condenser 806. Ozone is made harmless by the removing apparatus 808.

Thereafter, the toner particle dispersion in the stirring tank 704 is put into the rotation cylinder type dehydrator 705 and separated from the liquid so as to form a toner cake. The toner cake is washed by water and dehydrated by high speed rotation of the basket of the rotation cylinder type dehydrator 705, and is taken out from the take out opening by a scraper. The output toner cake is stocked in a stock tank and, preferably after pulverized, sent to the dryer 706 so as to obtain toner particles by drying.

Figure 2:
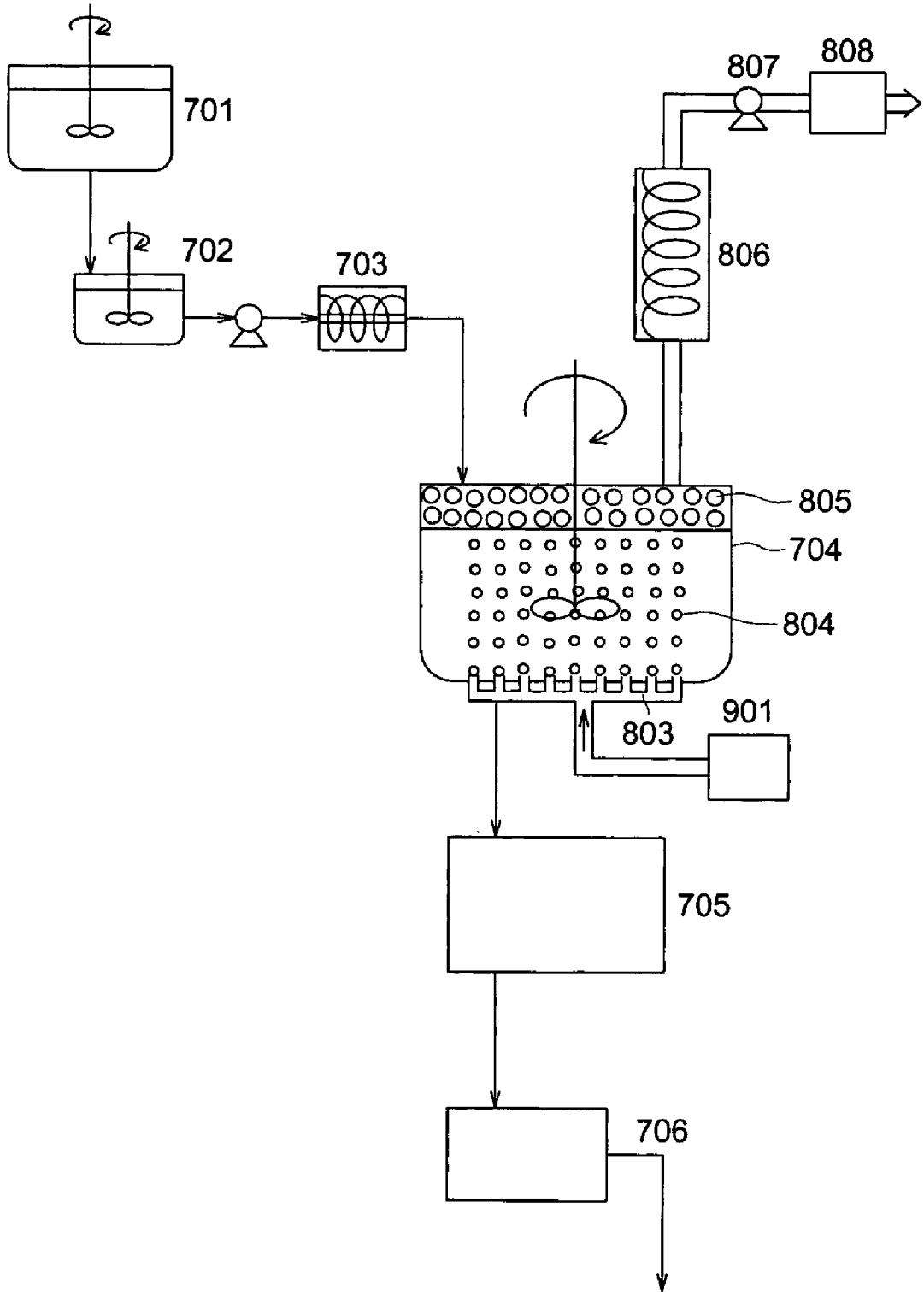
FIG. 2 shows the production flow chart of an example of a production method of toner particle preferably employed in the invention, in which air, oxygen or nitrogen is employing for the bubble treatment.

FIG. 2 shows a flow chart of an example of preferable toner particle producing method employing air, oxygen or nitrogen for bubbling treatment.

In FIG. 2, 701 is a reaction vessel, 702 is a stock tank, 703 is a concentrator, 704 is a stirring tank, 705 is a rotation cylinder type dehydrator, 706 is a dryer, 901 is a gas supplier for supplying gas such as air, oxygen or nitrogen, 803 is a bubbling nozzle, 804 is bubbles, 805 is foam, 806 is a condenser, 807 is a suction apparatus and 808 is a volatile component removing apparatus.

The toner particle dispersion prepared in the reaction vessel 701 is sent to the stock tank and temporarily stocked. The particle dispersion stocked in the stock tank 702 is concentrated by the concentrator 703 and sent to the stirring tank 704. Volatile substances having a specific gravity smaller than that of water are previously removed in the concentrator 703. In the stirring tank 704, the solid mass of the toner-particles by the concentration are re-dispersed by adding water so as to prepare toner particle dispersion having a concentration suitable for solid-liquid separation and to dissolve water-soluble the volatile substances in the water. After that, gas such as air, oxygen or nitrogen is expired under liquid surface in the stirring tank 704 through the nozzles 803, the bubbles of the gas 804 surface accompanied with the volatile substances adhering to the toner particle and removed in a form of the foam 805. When the volatile substances are decomposed by the bubbles, the decomposed substances are removed by the same way.

The bubbles 805 accompanying the gas formed by the decomposition of the volatile substances and the volatile substances are removed out from the system by the suction apparatus 707 after the liquid is separated by the condenser 806. The volatile substances are removed by the removing apparatus 808.

In the processes after the above, the same operations in FIG. 1 are performed.

Figure 3:
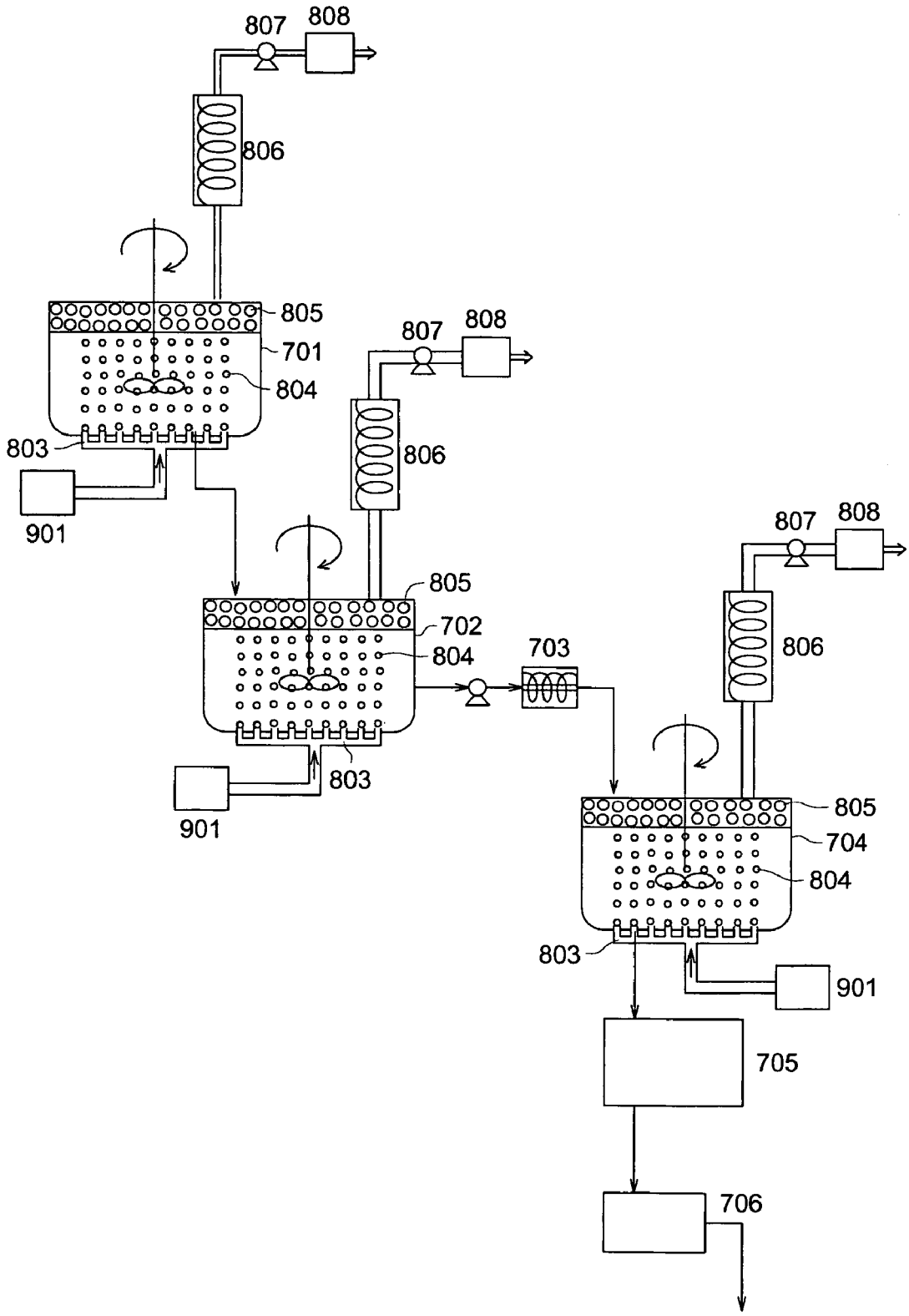
FIG. 3 shows the production flow chart of an example of a production method of toner particle preferably employed in the invention, in which the bubble treatment is carried out in a reaction vessel, a stock tank and a stirring tank.

FIG. 3 shows a process flow chart of an example of preferable toner particle producing method. The bubbling is performed at the reaction vessel, stock tank and the stirring tank.

In FIG. 3, 701 is a reaction vessel, 702 is a stock tank, 703 is a concentrator, 704 is a stirring tank, 705 is a rotation cylinder type dehydrator, 706 is a dryer, 901 is a gas supplier for supplying gas such as air, oxygen or nitrogen, 803 is a bubbling nozzle, 804 is bubbles, 805 is foam, 806 is a condenser, 807 is a suction apparatus and 808 is a volatile component removing apparatus.

The operations are the same as in FIG. 2 except that the bubbling treatment is performed in the reaction vessel, stock tank and stirring tank.

A compound so called external additive may be added to the toner particles according to the invention for improving the fluidity and the cleaning suitability of the toner even though the toner particles may be employed in intact state. Various inorganic particles, organic particles and lubricants can be employed as the external additive without any limitation.

As the inorganic particle usable as the external additive, fine particles of silica, titania, and alumina are preferably usable. These inorganic particles are preferably hydrophobic.

Concrete examples of the silica fine particle include R-805, R-976, R-974, R-972, R-812 and R-809 manufactured by Nihon Aerosil Co., Ltd., HVK-2150 and H-200 manufactured by Hoechst Co., Ltd., TS-720, TS-530, TS-610, H-5, MS-5 and spherical monodispersed silica manufactured by Cabot Co., Ltd. The above products are available on the market.

Concrete examples of the titania fine particle include T-805 and T-604 manufactured by Nihon Aerosil Co., Ltd., MT-100S, Mt-100B, MT-500BS, MT-600, MT600SS and JA-1 manufactured by Teika Co., Ltd., TA-300S1, TA-500, TAF-130, TAF-510 and TAF-510T manufactured by Fuji Titan Co., Ltd, IT-S, IT-OA, IT-OB, IT-OC and rutile type titanium oxide manufactured by Idemitsu Kosan Co., Ltd. The above products are available on the market.

Concrete examples of the alumina fine particle include RFY-C and C-604 manufactured by Nihon Aerosil Co., Ltd., and TTO-55 manufactured by Ishihara Sangyo Co., Ltd. The above products are available on the market.

As the organic fine particle usable for the external additive, a spherical fine particle having a number average primary particle diameter of from 10 to 2,000 nm is usable. Polystyrene, polymethyl methacrylate and styrene-methyl methacrylate copolymer are usable for the constituting material of such the fine particle.

A metal salt of higher fatty acid can be employed as the lubricant usable as the external additive. Concrete examples of such the higher fatty acid metal salt include a metal stearate such as zinc stearate, aluminum stearate, copper stearate, magnesium stearate and calcium stearate; an metal oleate such as zinc oleate, manganese oleate, iron oleate, copper oleate and magnesium oleate; a metal palmitate such as zinc palmitate, copper palmitate, magnesium palmitate and calcium palmitate; a metal linolate such as zinc linolate and calcium linolate; and a metal ricinolate such as zinc ricinolate calcium ricinolate.

The adding amount of the external additive is preferably about from 0.1 to 5% by weight.

For adding and mixing the external additive to the toner particles, various mixing apparatus such as a tabular mixer, a Henschel mixer, a Nauter mixer and a V type mixer are applicable.

The developer is described below.

It is preferable that the toner is employed as a double-component developer by mixing with a carrier.

Known magnetic particles comprising a metal such as iron, ferrite and magnetite or an alloy comprising the above metal and another metal such as aluminum and lead are employable for the carrier. Among them, ferrite particle is preferred. The volume average particle diameter of the magnetic particles is preferably from 15 to 100 μm, and more preferably from 25 to 80 μm.

The volume average particle diameter can be measured by a laser diffraction type particle size distribution measuring apparatus HELOS, manufactured by Synpatic Co., Ltd.

Both of carrier comprised of the magnet particle covered with resin and that comprised of the magnetic particle dispersed in resin so-called resin-dispersed type carrier are usable. Known resin such as an olefin type resin, a styrene type resin, a styrene type resin, a styrene-acryl type resin, a silicone type resin, an ester type resin and a fluorinated polymer type resin can be used for covering the magnetic particle without any limitation.

Image forming method is described below.

An image forming method in which the image is thermally fixed is preferred.

A contact fixing method such as a heat roller method, and a non-contact fixing method such as a oven fixing method, a flash fixing method and a microwave fixing method are applicable for the mixing method.

Figure 4:
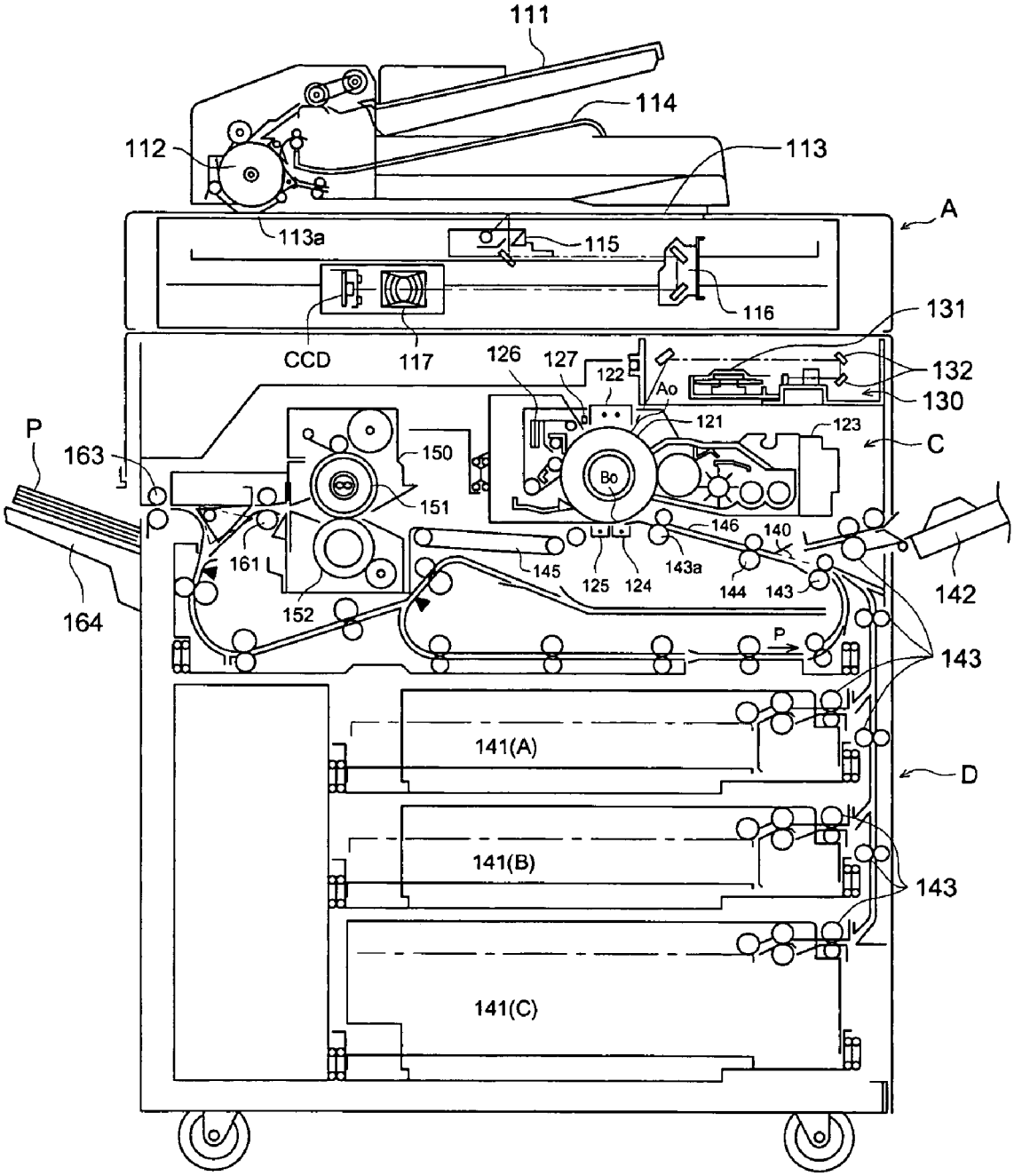
FIG. 4 shows the cross section of an example of an image forming apparatus showing the image forming method employing the toner relating to the invention.

FIG. 4 is a cross section of an image forming apparatus showing an example of the image forming method employing the toner relating to the invention.

The image forming apparatus of FIG. 4 is an image forming apparatus by digital system which is constituted by an image reading part A, an image processing part B (not shown in the drawing), an image forming part C and an image receiving paper conveying part D as an image receiving paper conveying means.

At the upper portion of the image reading part A, an automatic original conveying means for automatically conveying an original image is provided, and the original image sheets placed on an original placing stand 111 is conveyed one by one by an original conveying roller 112 and the image is read at the image reading position 113*a*. After completion of the reading, the original is output on to an original output tray 114.

The original image placed on a platen glass 113 is read out by the reading action at a rate of v of a first mirror unit 115 composed of a illuminating lamp and a first mirror, which constitutes an optical scanning system, and by motion at a rate of v/2 in the same direction of a second mirror unit 116 constituted by a second mirror and a third mirror arranged so as to form V-shaped position.

The read image is focused on the light receiving face of an image taking element CCD as a line sensor. The line-shaped optical image focused on the image taking element CCD is successively converted to electric signals (illuminance signals) and then subjected to A/D conversion. After that, the image signals are subjected to treatments such as density conversion and filtering treatment in the image processing part B and then temporarily stored in a memory.

In the image forming part C, an image forming unit is constituted by a drum-shaped photoreceptor, hereinafter referred to as photoreceptor drum, 121 and a charging device 122 as a charging means, a developing device 123 as a developing means, a transferring device 124 as a transferring device, a separating device 125 as a separating means, a cleaning device 126 and a pre-charging lamp (PCL) 127 are each arranged around the photoreceptor drum in order of the acting. The photoreceptor 121 is constituted by coating a photoconductive compound, and for example, an organic photoconductive compound (OPC) is preferably employed. The photoreceptor drum is driven so as to be rotated clockwise in the drawing.

The rotating photoreceptor 121 is uniformly charged by the charging device 122 and imagewise exposed by an exposing optical system 130 according to the image signals called up from the memory of the image processing part B. In the writing means of the exposing optical system 130, a light beam emitted from a laser diode as a light source, not shown in the drawing, is passed through a rotating polygon mirror 131, an fθ lens (with no symbol) a cylindrical lens (with no symbol) and reflected by a reflecting mirror so as to perform main-scanning. The imagewise exposure is given to the photoreceptor 121 at the position $A_0$ and a latent image formed by the rotation of the photoreceptor 121 (sub-scanning).

The latent image formed on the photoreceptor 121 is reversely developed by the developing device 123 to form a visible toner image on the surface of the photoreceptor 121. In the image receiving paper conveying part D, paper supplying units 141A, 141B and 141C are provided as image receiving paper storage means in each of which image receiving paper P different in the size is stocked, and a hand paper supplying unit 142 for supplying the paper by human hand is further provided on the side. The image receiving paper P selected from any one of paper supplying units is supplied along a conveying pass 140 by a guide roller 143 and temporarily stopped by a resist roller 144 for correcting the leaning and biasing of the paper. After that, the image receiving paper P is started and guided by the conveying pass 140, a roller before transferring 143*a* and a guiding plate 146. The toner image on the photoreceptor 121 is transferred to the image receiving paper P at a transferring position $B_0$ by a transferring device 124, and then the image receiving paper P is separated from the photoreceptor surface by discharging by a separating device 125 and conveyed to the thermal fixing device 150 by a conveying device 145.

The thermal fixing device has a heat fixing roller 151 and a pressing roller 152, and the toner is fused by heating and pressing by passing the image receiving paper P between the heat fixing roller 151 and the pressing roller 152. After the thermal fixing of the toner image, the image receiving paper P is cooled by a cooling device 163 and output on a paper outputting tray 164. The image receiving paper P output on the paper out putting tray 184 is trued up by human hands for utilizing. It is preferable to cool the image receiving paper by the cooling device so that the temperature of the paper just after the output is made to not more than 80° C.

The image forming apparatus may be one for forming a color image. In such the case, a number of developing devices 123 corresponding to each of the colors are arranged around the photoreceptor 121, or a number of photoreceptors corresponding to each of the colors are independently arranged and the toner images at each of the positions are successively transferred to an intermediate transfer member or directly to a image support such as paper.

EXAMPLES

The invention is concretely described below referring examples.

<<Preparation of Toner>>

<Preparation of Toner Particle Dispersion 1 (Example of Emulsion Association Method>

(Preparation of Latex 1HML)

(1) Preparation of Nucleus Particle (the First Step of Polymerization)

A surfactant solution (aqueous medium) prepared by dissolving 7.08 g of anionic surfactant SU in 3010 g of deionized water was put into a 500 ml separable flask to which a stirring device, a thermal sensor, a cooler and a nitrogen introducing device were attached and the temperature in the flask was raised by 80° C. while stirring at 230 rpm under a nitrogen gas stream.

(SU)

$$C_{10}H_{21}(OCH_2CH_2)_2OSO_3Na$$

To the surfactant solution, an initiator solution prepared by dissolving 9.2 g of a polymerization initiator (potassium persulfate: KPS) in 200 g of deionized water was added and the temperature was adjusted at 75° C., and then a monomer mixture composed of 70.1 g of styrene, 19.9 g of n-butyl acrylate and 10.9 g of methacrylic acid was dropped spending for 1 hour. The resultant system was further heated and stirred for 2 hours at 75° C. for carrying out polymerization (the first step polymerization) to prepare latex (dispersion of particles of polymer resin). The latex was referred to as Latex 1H.

(2) Formation of Intermediate Layer (the Second Step Polymerization)

In a flask having a stirring device, 98.0 g of a compound represented by the following composition, hereinafter referred to as Compound RA as a parting agent was added to a monomer mixture liquid composed of 105.6 g of styrene, 30.0 g of n-butyl acrylate, 6.2 g of methacrylic acid and 5.6 g of n-octyl-3-mercaptopropionic acid ester and dissolved by heating by 90° C. to prepare a monomer solution.

Compound RA $$H_3(CH_2)_{20}COOCH_2C(CH_2OCO(CH_2)_{20}CH_3)_3$$

Besides, a surfactant solution prepared by dissolving 1.6 g of the surfactant SU in 2700 ml of deionized water was heated by 98° C., and 28 g in terms of solid component of the nucleus particle dispersion Latex 1H was added to the surfactant solution. After that, the above monomer solution of the compound RA was added and dispersed by a mechanical dispersing machine having a circulation pass CLEARMIX, manufactured by M-Technique Co., Ltd., for 8 hours to prepare a dispersion (emulsion) containing emulsified particles (oil droplets) having a particle diameter of 284 nm.

Thereafter, an initiator solution prepared by dissolving 5.1 g of the polymerization initiator (KPS) in 240 ml of deionized water and 750 ml of deionized water were added to the above dispersion (emulsion), and the resultant system was heated and stirred fro 12 hours at 98° C. for carrying out the second step polymerization. Thus latex or dispersion of a composite resin particle constituted by the resin particle of high molecular weight polymer resin covered with intermediate molecular weight resin was obtained. The latex was referred to as Latex 1HM.

(3) Formation of Outer Layer (the Third Step Polymerization)

To the above-obtained Latex 1HM, an initiator solution prepared by dissolving 7.4 g of the polymerization initiator (KPS) in 200 ml of deionized water was added, and then a monomer mixture liquid composed of. 300 g of styrene, 95 g of n-butyl acrylate, 15.3 g of methacrylic acid and 10.4 g of n-octyl-3-mercaptopropionic acid ester was dropped spending 1 hour at 80° C. After completion the dropping, the heating and stirring were further continued for 2 hours for carrying out polymerization (the third step polymerization) and then cooled by 28° C. Thus latex or dispersion of a composite particle having the central portion of the high molecular weight polymer, the intermediate layer of the intermediate molecular weight polymer in which the compound RA was contained and an outer layer of low molecular weight polymer was obtained. The latex was referred to as Latex 1HML.

The composite particle constituting Latex 1HML had peaks of molecular weight at 138,000, 80,000 and 13,000, and the weight average particle diameter of the particle was 122 nm.

(Preparation of Toner Particle Dispersion)

In 1600 ml of deionized water, 59.0 g of a anionic surfactant, sodium dodecylsulfate, was dissolved by stirring, and 420.0 g of C.I. Pigment Blue 15:3 was gradually added, and then dispersed by CLEARMIX, manufactured by M-Technique Co., Ltd., to prepare dispersion of colorant particle. To a reaction vessel (a four mouth flask) on which a thermal sensor, a cooler, a nitrogen introducing device and a stirring device were attached, 420.7 g of Latex 1HML in terms of solid component, 900 g of deionized water and 166 g of the dispersion of colorant particle were charged and stirred. After adjusting the temperature in the vessel at 30° C., a 5 moles/liter solution of sodium hydroxide was added to adjust the pH to 8.

Thereafter, a solution prepared by dissolving 12.1 g of magnesium hexahydrate in 1,000 ml of deionized water was added to the above system at 30° C. spending 10 minutes while stirring. After standing for 3 minutes, the resultant system was heated by 90° C. spending for a time of from 6 to 60 minutes to for associating the particles. The diameter of the associated particle was measured in such the situation by Coulter Counter TA-II, manufactured by Coulter Counter Co., Ltd. A solution prepared by dissolving 80.4 g of sodium chloride in 1,000 ml of deionized water was added to stop the particle growing when the volume average diameter of the associated particles was attained to 6.4 μm. The resultant system was further stirred at a liquid temperature of 98° C. for 2 hours for ripening to complete the fusion of the particles.

After that the liquid was cooled by 30° C. and the pH of the liquid was adjusted to 4.5 by addition of hydrochloric acid to prepare Toner Particle Dispersion 1.

(Preparation of Toner Particle Dispersion 2)

(Preparation of Resin Particle Dispersion)

A liquid prepared by nixing and dissolving 370 g of styrene, 30 g of n-butyl acrylate, 8 g of acrylic acid, 24 g of dodecanethiol and 4 g of carbon tetrabromide was emulsion polymerized in a solution prepared by dissolving 6 g of a nonionic surfactant, nonyl phenyl ether and 10 g of an anionic surfactant, sodium dodecylbenzenesulfonate, in 500 g of deionized water charged in a flask. After that, a solution prepared by dissolving 4 g of ammonium persulfate in 50 g of deionized water was put into the above flask spending 10 minutes while slowly stirring. After exchanging air by nitrogen, the content of the flask was heated by 70° C. in an oil bath and the emulsion polymerization was continued for 5 hours under this condition. As a result of that, Fine Resin Particle Dispersion 2 in which resin particles having a volume average particle diameter of 150 nm, a glass transition point of 58° C. and a weight average molecular weight of 11,500 were dispersed. The concentration of solid component in the dispersion was 40% by weight.

(Preparation of Colorant Dispersion)

| | |
|---|---|
| Colorant: C.I. Pigment Blue 15:3 | 60 parts by weight |
| Nonionic surfactant: nonyl phenyl ether | 5 parts by weight |
| Deionized water | 240 parts by weight |

The above components were mixed and dissolved, and stirred by a homogenizer Ultratalax T50, manufactured by IKA-WERKE GMBH & CO., KG. Thereafter, the liquid was subjected to dispersing treatment by an ultimizer to prepare a dispersion of the colorant particles having a volume average diameter of 250 nm. The colorant particle dispersion was treated by air bubble for 5 minutes. Thus Colorant Dispersion 2 was obtained.

(Preparation of Parting Agent Dispersion)

| | |
|---|---|
| Paraffin wax (melting point: 97° C.) | 100 parts by weight |
| Cationic surfactant: Alkyl ammonium salt | 5 parts by weight |
| Deionized water | 240 parts by weight |

The above components were dispersed for 10 minutes by a homogenizer Ultratalax T50, manufactured by IKA-WERKE GMBH & CO., KG, in a spherical stainless steel flask, and then a dispersed by a pressure jetting type homogenizer to prepare Parting Agent Dispersion 2 was prepared in which particles of the parting agent having a volume average diameter of 550 nm were dispersed.

(Preparation of Coagulated Particle)

| | |
|---|---|
| Fine Resin Particle Dispersion 2 | 234 parts by weight |
| Colorant Dispersion 2 | 30 parts by weight |
| Parting Agent Dispersion 2 | 40 parts by weight |
| Polyaluminum chloride | 1.8 parts by weight |
| Deionized water | 600 parts by weight |

The above components were mixed by the homogenizer Ultratalax T50, manufactured by IKA-WERKE GMBH & CO., KG, in a spherical stainless steel flask, after dispersion, the liquid was heated by 55° C. in an oil bath while stirring in the flask. After standing for 30 minutes, it was confirmed that coagulated particles having a D50 of 4.8 μm were formed. The D50 became to 5.9 μm by raising the temperature of the heating oil bath by 56° C. and holding for 2 hours. After that, 32 parts by weight of Resin Fine Particle Dispersion 2 was added to the dispersion containing the above coagulated particles, and then the temperature of the heating oil bath was raised by 55° C. and held for 30 minutes to prepare coagulated particles. The coagulated particles were treated by air bubbles for 5 minutes. Thus Coagulated Particle 2 was obtained. To the dispersion containing Coagulated Particle 2, a 1 mole/liter solution of sodium hydroxide was added to adjust the pH of the system to 5.0, and then the stainless steel flask was sealed by magnetic sealing and the heated by 59° C. while stirring and held for 6 hours to prepare a toner particle dispersion. The toner particle dispersion was treated for 5 minutes by air bubbles. Thus Toner Particle Dispersion 2 was obtained.

<Preparation of Toner Particle Dispersion 3 (Example of Polyester Resin Association Method)>

(Preparation of Polyester Resin)

To a vessel for condensation polymerization reaction, 715.0 g of dimethyl phthalate, 95.8 g of sodium dimethyl 5-sulfoisophthalate, 526.0 g of propanediol, 48.0 g of diethylene glycol, 247.1 g of dipropylene glycol and 1.5 g of butyl tin hydroxide as catalyst were charged. The resultant mixture was heated by 190° C. and then the temperature was slowly raised by about 200 to 202° C. while collecting by-producted alcohol into a receiving receptacle. After that, the temperature was raised by 210° C. spending 4.5 hours while reducing the pressure from the atmospheric pressure to about 1067 Pa. The product was taken out. Thus Polyester Resin 3 having a glass transition point of 53.8° C. was prepared.

(Preparation of Polyester Resin Emulsion)

To 1,232 g of deionized water, 168 g of Polyester Resin 3 was added and stirred for 2 hours at 92° C. to prepare Polyester Resin Emulsion 3.

(Association Process)

In a reaction vessel, 1,400 g of Polyester Resin Emulsion 3 and 14.22 g of C.I. Pigment Blue 15:3 were charged to prepare Emulsion/Dispersion 3.

Besides, a 5% weight-percent zinc acetate solution was prepared by dissolving zinc acetate in deionized water. The solution was put in a receptacle placed on a weighing scale and connected to a pump capable of supplying the zinc acetate solution exactly at a rate of from 0.01 to 9.9 ml/minute. The amount of zinc acetate necessary for the association of the emulsion was 10% of the weight of the resin in the emulsion.

Emulsion/Dispersion 3 was heated by 56° C. and the zinc acetate solution was supplied at a rate of 9.9 ml/minute to start association. When 60% by weight of the entire amount of zinc acetate (205 g of 5 weight-percent solution) was added, the adding rate of the solution was reduced to 1.1 ml/minute and the supply of the zinc acetate solution was continued by the added amount of zinc acetate was attained to 10 weight-percent of the resin in the emulsion (335 g of 5 weight-percent solution), and the system was stirred for 9 hours at 80° C. to prepare Toner Particle Dispersion 3.

<Preparation of Toner Particle Dispersion 4 (Example of Suspension Polymerization)>

A mixture of 165 g of styrene, 35 g of n-butyl acrylate, 10 g of C.I. Pigment Blue 15:3, 2 g of metal compound of di-t-butyl salicylate, 8 g of styrene-methacrylic acid copolymer and 20 g of paraffin wax (mp=70° C.) was heated by 60° C. and uniformly dissolved and dispersed by TK Homomixer, manufactured by Tokushu Kika Kogyo Co., Ltd., at 12,000 rpm. In the resultant liquid, 10 g of 2,2'-azobis(2,4-valeronitrile) was dissolved as a polymerization initiator to prepare Polymerizable Monomer Composition 4. On the other hand, 450 g of a 0.1 M sodium phosphate solution was added to 710 g of deionized water and 68 g of a 1.0 M calcium chloride solution was gradually added while stirring by TK Homomixer at 13,000 rpm to prepare Suspension 4 in which calcium triphosphate is dispersed. Polymerizable Monomer Composition 4 was added to Suspension 4 and stirred by TK Homomixer for 20 minutes at 10,000 rpm to form granules of Polymerizable Monomer Composition 4. After that, reaction was carried out for a time of from 5 to 15 hours at a temperature of from 75 to 95° C. Toner Particle Dispersion 4 was prepared by removing calcium triphosphate by hydrochloric acid.

<Preparation of Toner Dispersion 5 (Example of Dissolving Suspension Method)>

(Preparation of Pigment Dispersion)

| | |
|---|---|
| Polyester resin (Tg: 60° C., softening point: 98° C., weight average molecular weight: 9,500) | 50 parts by weight |
| C.I. Pigment Blue 15:3 | 50 parts by weight |
| Ethyl acetate | 100 parts by weight |

Dispersion of the above components and glass beads were put into a vessel and the vessel was set on a sand mill disperser. Dispersion was carried out for 8 hours in a high speed stirring mode while cooling around the vessel. After that, the resultant dispersion was diluted to prepare Pigment Dispersion 5 having a pigment concentration of 15% by weight.

(Preparation of Pulverized Wax Dispersion)

| | |
|---|---|
| Paraffin wax (melting point: 85° C.) | 15 parts by weight |
| Toluene | 85 parts by weight |

The above components were put into a dispersing machine having stirring wings and a function of circulating a thermal medium around the vessel. The temperature of the mixture was gradually raised and stirred for 3 hours while keeping at 100° C. After that, the resultant liquid was cooled by room temperature at a rate of 2° C. pre minute so as to precipitate pulverized wax. Thus obtained wax dispersion was re-dispersed by a high pressure emulsifying machine APV Gaulin Homogenizer, manufactured by APV Gaulin Co., Ltd., at a pressure of $550\times10^5$ Pa. The viscosity of the wax measured at the same time was 0.69 μm. Thus prepared pulverized wax dispersion was diluted by ethyl acetate so the concentration of the wax became to 15% by weight. Thus Pulverized Wax Dispersion 5 was prepared.

(Preparation of Oil Phase)

| | |
|---|---|
| Polyester resin (Tg: 60° C., softening point: 98° C., weight average molecular weight: 9,500) | 85 parts by weight |
| Pigment Dispersion 5 (Pigment concentration: 15 weight-percent) | 50 parts by weight |
| Pulverized Wax Dispersion (wax concentration: 15 weight-percent) | 33 parts by weight |
| Ethyl acetate | 32 parts by weight |

After confirmation of complete dissolution of the polyester resin in the above composition, the resultant solution was put into a homomixer Ace Homogenizer, manufactured by Nihon Seiki Co., Ltd., and stirred for 2 minutes at 16,000 rpm to prepare uniform Oil Phase 5.

(Preparation of Water Phase)

| | |
|---|---|
| Calcium hydroxide (average particle diameter: 0.03 μm) | 60 parts by weight |
| Deionized water | 40 parts by weight |

The above components were stirred in a ball mill for 4 days. Thus obtained aqueous solution of calcium carbonate was referred to as Water Phase (calcium carbonate aqueous solution) 5. The average particle size of the calcium carbonate measured by a laser diffraction/scattering particle size distribution measuring apparatus A-700 manufactured by Horiba Ltd., was 0.08 μm.

| | |
|---|---|
| Carboxymethyl cellulose | 2 parts by weight |
| Purified water | 98 parts by weight |

The above components were stirred by a ball mill. The resultant aqueous solution of carboxymethyl cellulose was referred to as Water Phase (carboxymethyl cellulose aqueous solution) 5.

(Preparation of Spherical Particle)

| | |
|---|---|
| Oil Phase 5 | 55 parts by weight |
| Water Phase (calcium carbonate aqueous solution) 5 | 15 parts by weight |
| Water Phase (carboxymethyl cellulose aqueous solution) 5 | 30 parts by weight |

The above components were put into Colloid Mill, manufactured by Nihon Seiki Co., Ltd., and emulsified at a width of gap of 1.5 mm and a rotating speed of 9,400 rpm. The resultant emulsion was put into a rotary evaporator and the solvent was removed for 2 hours under a reduced pressure of 4,000 Pa at room temperature.

Thereafter, a 12 mole/liter solution of hydrochloric acid was added to make the pH value to 2 for removing calcium carbonate from the surface of toner particle. After a 10 moles/liter solution of sodium hydroxide was added to make the pH value to 10 and the liquid was stirred for 1 hour in an ultrasonic washing tank. Thus Toner Particle Dispersion 5 was prepared.

<Preparation of Toner Particle Dispersion 6 (Example of Continuous Emulsifying Dispersion Method)>

(Synthesis of Polyether Resin A)

In a high pressure reaction vessel having a stirring device, a nitrogen introducing pipe, a thermometer and an opening for raw material input, 0.5 parts by weight and 200 parts by weight of toluene as solvent were charged, and a mixture of 10.8 parts by weight of propylene oxide and 89.2 parts by weight of styrene oxide were gradually injected while stirring and maintaining the pressure and the temperature in the system at $10\times10^5$ Pa and 40° C., respectively. The variation of the molecular weight was traced by terminal titration method and the reaction was stopped at a time when the number average molecular weight became to 7,000. At this occasion, the injected amount of the propylene oxide was 8.46 parts by weight and that of styrene oxide was 71.4 parts by weight. Toluene and unreacted monomer were removed from the resultant polymer solution under a reduced pressure of 4,000 Pa to prepare Polyether Resin A was obtained.

(Synthesis of Polyester Resin B Having No Ether Bond)

In a flask of interior volume of 500 litters having a stirring device, a nitrogen introducing pipe, a thermometer and a rectifier, 67.85 parts by weight of terephthalic acid, 3.34 parts by weight of neopentyl glycol, 25.58 parts by weight of propylene glycol, 3.34 parts by weight of trimethylolpropane and 0.3 parts by weight of dibutyl tin oxide were charged and reacted by stirring under nitrogen stream at 240° C. The reaction was stopped when the softening point measured by a ring and ball method became to 130° C. Thus Polyester Resin B was obtained. The Polyester Resin B was light colored solid and the weight average molecular weight in terms of styrene measured by a GPC measuring method thereof was 96,000.

Molten colored resin heated at 180° C. was prepared by kneading 18 parts by weight of Polyether Resin A, 72 parts by weight of Polyester Resin B and 10 parts by weight of C.I. Pigment Blue 15:3 by a double axis continuous kneading machine, and transferred to a rotation type continuous dispersing apparatus CABITRON CD 1010, manufactured by Eurotech Co., Ltd., at a rate of 10 g per minute. Besides, diluted ammonia water having a concentration of 0.37 weight-percent prepared by diluting reagent grade ammonia water by deionized water was stocked in a tank for an aqueous medium. The diluted ammonia water was transferred simultaneously with the molten colored resin to the CABITRON at a rate of 0.1 liter per minute while heating by 150° C. The resultant mixture was dispersed at a rotation rate of rotator of 7.500 rpm and a pressure of $5\times10^5$ Pa to prepare dispersion of fine particles of colored resin at 160° C. The dispersion was cooled by 40° C. spending 10 seconds. Thus Toner Particle Dispersion 6 was obtained.

(Bubbling Treatment)

The above-prepared Toner Particle Dispersions 1 through 6 were each dehydrated and condensed by a concentration apparatus and sent to the stirring tank. In the stirring tank, the concentrated toner particles are re-dispersed by adding water and adjusted to suitable concentration for solid-liquid separation. After that, bubbling was performed by 5 $m^3$ per liter of the toner particle dispersion of the gas described in Table 1, ozone-containing air, air, oxygen or nitrogen, was expired from the nozzle provided under the liquid surface in the stirring tank. The volatile substances adhering to the toner particle was decomposed to gas or adsorbed by the bubbles. The gas used for the bubbling, the gas formed by the decomposition of the volatile substances, and form adhering the volatile substances were exhausted out from the system through the upper portion of the stirring tank by a suction device. Ozone and the gas formed by the decomposition were made harmless through a volatile component removing apparatus using active carbon and then exhausted out to atmosphere.

(Preparation of Toner Particle)

Each of the above-prepared Toner Particle Dispersions 1 through 6 was subjected to solid-liquid separation by a rotating cylinder type dehydrator Mark III Type 60×40, manufactured by Matsumoto Machine Co., Ltd., to form a toner cake. The toner cake was washed in the rotating cylinder type dehydrator and raked out from the dehydrator by a scraper inserted in the machine and stored in a vessel. After that, the toner cake was supplied little by little to Flash Dryer, manufactured by Seishin Enterprise Co., Ltd., and dried by the moisture content of the toner particle became 0.5% by weight to prepare Toner Particles 1 through 13.

(Preparation of Toner)

To 100 parts by weight of each of the Toner Particles 1 through 12, 0.8 parts by weight of rutile type titanium oxide (volume average particle diameter: 20 nm, treated by n-decyltrimethoxysilane) and 1.8 parts by weight of spherical monodispersed silica (Prepared by drying and powdered HMD treated sol-gel method silica sol, particle diameter D50: 127 nm) were mixed and blended for 15 minutes by HENSCHEL MIXER, manufactured by Mitsui Miike Kako Co., Ltd., at a circumference speed of 30 m/s. Then the mixture was sieved through a filter having an opening of 45 μm for removing coarse particles. Thus prepare Toners 1 through 12 were prepared.

<<Preparation of Developer>>

Each of the above-prepared Toners 1 through 12 was mixed with ferrite carrier having a volume average particle diameter of 60 μm to prepare Developers 1 through 12 having a toner concentration of 6%.

The toner particle dispersion employed to the preparation of the toner, the kinds of gas, the content of ozone, the particle diameter of toner and the measuring result by head space method are listed in Table 1. In the table "Ozone" represents air containing ozone.

TABLE 1

| Toner No. | Toner particle dispersion No. | Kind of gas | Ozone content (ppm) | Average particle diameter of toner (μm) | Measuring result by head space method (ppm) |
|---|---|---|---|---|---|
| 1 | 1 | Air | — | 4.6 | 3.8 |
| 2 | 1 | Oxygen | — | 4.6 | 2.9 |
| 3 | 1 | Nitrogen | — | 4.6 | 3.2 |
| 4 | 1 | Ozone | 3 | 4.6 | 0.9 |
| 5 | 1 | Ozone | 1 | 4.6 | 2.0 |
| 6 | 2 | Ozone | 1 | 6.6 | 1.3 |
| 7 | 3 | Ozone | 1 | 3.8 | 2.0 |
| 8 | 4 | Ozone | 1 | 8.5 | 10.7 |
| 9 | 5 | Ozone | 1 | 4.1 | 3.5 |
| 10 | 6 | Ozone | 1 | 3.8 | 2.0 |
| 11 | 1 | Ozone | 25 | 4.6 | 0.6 |
| 12 | 1 | — | — | 4.6 | 50.0 |

<<Evaluation>>

(Evaluation of Practical Photographing)

The developer and the toner were charged in the developing device of Digital copying machine 7065, manufactured by Konica Corp., and subjected to the evaluation according to the following items.

<<Evaluation Results>>

(Scatter of Charging Amount Between the Toner Lots)

Ten batches of each of Toners 1 through 12 were prepared and the scatter of charging amount was evaluated.

Each of the above prepared ten butches of the toner was mixed with the foregoing carrier to prepare samples for measuring having a toner concentration of 6 weight percent and the charging amount of the sample was measured under environment of a temperature of 30° C. and a relative humidity of 80% for determining of the scatter of charging amount. The charging amount was measured by a blow off method.

Evaluation Norms

A: The charging amounts of the 10 batches were within the range of ±0.3 μC/g of the center value; the scatter was very small and no problem was posed in the practical use.

B: The charging amounts of the 10 batches were within the range of ±0.6 μC/g of the center value; the scatter was small and no problem was posed in the practical use.

C: The charging amounts of the 10 batches were within the range of ±1.0 μC/g of the center value; though the scatter was slightly large, no problem was posed in the practical use.

D: The charging amounts of the 10 batches were without the range of ±1.0 μC/g of the center value; the scatter was large so as to cause a problem for practical use.

(Storage Stability of Toner)

Two grams of each of the toners was put into a sampling tube and vibrated for 500 times by a tapping denser and the stood for 2 hours under environment of a temperature of 55° C. and a relative humidity of 35%. After that, the sample was put into a sieve of 48 μm mesh and sieved under a certain vibration condition and the ratio in weight percent of toner remaining on the mesh was measured. The ratio the remaining toner was defined as the coagulation ratio, and the evaluated according to the following norm.

A: The coagulation ratio of was less than 15% by weight; the storage stability of the toner is excellent; no problem was posed on the occasion of image formation.

B: The coagulation ratio of was from 15 to 45% by weight; the storage ability of toner was good; no problem was posed on the occasion of image formation.

C: The coagulation ratio of was from 46 to 60% by weight; the storage stability of the toner was slightly inferior; a few problem was posed on the occasion of image formation but acceptable for use.

D: The coagulation ratio of was more than 60% by weight; the storage stability of the toner was bad; not acceptable for use since a problem was posed on the occasion of image formation.

(Adhesion of Output Image Receiving Paper)

A digital copying machine 7065, manufactured by Konica Corp., was employed for evaluation, in which a cooling device was attached just after the thermal fixing and adjusted so that the surface temperature of the output image receiving paper became 75° C.

Five hundreds duplex prints were prepared using A4 size 64 g/m$^2$ image receiving paper by copying an original image having a pixel ratio of 7% (image was divided to four equal area respectively having character images, a portrait, a solid white image and a solid black image) under environment of a temperature of 33° C. and a relative humidity of 80%. Easiness of truing up the 500 sheets of the prints on the output tray after completion of the printing of 500 sheets was evaluated as the adhesion of the printed paper.

A: The image receiving sheets could be uniformly trued up by holding the both ends of the paper by hands and tapping ten times to the surface of a table.

B: The image receiving sheets could be uniformly trued up by holding the both ends of the paper by hands and tapping ten times to the surface of a table and further tapping five times by hand on the upper end of the sheets.

C: The image receiving sheets could be uniformly trued up by holding the both ends of the paper by hands and tapping ten times to the surface of a table and further tapping ten times by hand on the upper end of the sheets.

D: The image receiving sheets could not be uniformly trued up even when the sheets were held the both ends of the paper by hands and tapped ten times to the surface of a table and further tapped ten times by hand on the upper end of the sheets since the face and the back of the sheets adhered with together.

(Fixing Ability of Toner)

(Fixing Ability on Extremely Thick Paper)

A gray frame having a relative density of 0.5 was continuously printed on 500 sheets of mourning post card, manufactured by Heart Co., Ltd., by a digital copying machine 7065, manufactured by Konica Corp. Thus obtained prints were ranked according to the following norms.

A: The toner was not peeled off at all even when letters were strongly written by an ordinary pen on the gray frame.

B: The toner was peeled off when the letters were strongly written by the ordinary pen but the toner was not peeled when the letters were written by a ballpoint pen.

D: Fixing of the toner was insufficient and the toner was peeled off and caused a dirty mark on the hand when the card was only taken by hand on the gray frame.

(Order)

An image occupied 50% of solid black was continuously copied for 1,000 sheets by a modified digital copying machine 7065, manufactured by Konica Corp., in which the fixing temperature of the fixing device was set at 175° C. and a cooling device was attached for cooling the printed sheet after the fixing so that the surface temperature of the printed sheet was 75° C. in a closed room of a floor of 5 m×5 m and a height of 2 m.

The evaluation of odor was carried out by 30 evaluating persons and the number of the person who felt the odor was counted.

A: No person felt the order

B: Not more than 3 persons felt the odor.

D: Four or more persons felt the odor.

The evaluation results are listed in Table 2.

TABLE 2

| Toner No. | Scatter of charging amount between lots | Storage stability of toner | Adhesion of output image receiving paper | Fixing ability of toner | Odor |
|---|---|---|---|---|---|
| 1 | B | B | B | A | B |
| 2 | B | B | B | A | A |
| 3 | B | B | B | A | A |
| 4 | B | A | A | B | A |
| 5 | A | A | A | A | A |
| 6 | A | A | A | A | A |
| 7 | A | A | A | B | A |
| 8 | A | A | A | B | B |
| 9 | A | A | A | A | A |
| 10 | A | A | A | A | A |
| 11 | A | A | A | A | A |
| 12 | D | D | D | A | D |

As is cleared from Table 2, as to Toners 1 through 11 treated by the bubbling, the scatter in the charging amount between the lots of the toner is prevented; the storage stability is excellent; the output image receiving paper sheets are easily trued (the adhesion between the output image receiving paper sheets is prevented); the fixing ability of the toner is good and the odor on the occasion of fixing is not felt, compared with the Toner 12 without treatment by the bubbling.

The invention claimed is:

1. A production method of an electrophotographic toner which comprises toner particles comprising a resin and a colorant, wherein the method comprises a step of;

forming toner particles in an aqueous medium, and processing an aqueous medium containing the toner particles or a component of the toner particles by gas bubbles containing ozone, in which ozone concentration is from 0.1 to 40 ppm.

2. The method of claim 1, wherein the gas is air or gas containing ozone.

3. The method of claim 2, wherein the gas is air.

4. The method of claim 2, wherein the gas is air containing ozone.

5. The method of claim 1, wherein the aqueous medium is water containing a surfactant.

6. The method of claim 1, wherein the component of the toner particles is a monomer, a colorant, a releasing agent or a charge control agent.

7. The method of claim 1, wherein the processing by gas is held in a stirring tank.

8. The method of claim 7, wherein the stirring tank has a stirring paddle and a nozzle ejecting the gas to form the bubbles provided under level of the aqueous medium.

9. The method of claim 1, which further comprises a step of exposing aqueous medium containing the toner particles or a component of the toner particles to light.

10. A toner produced by a method of claim 1, which has a peak of volatile substance between n-hexane and n-hexadecane and total area of the peak is toluene converted value of 0.5 to 20 ppm measured by head space gas spectroscopy.

11. The method of claim 1, wherein the ozone concentration is from 0.3 to 20 ppm.

12. A production method of an eletrophotographic toner which comprises toner particles comprising a resin and a colorant, wherein the method comprises a step of;

forming toner particles in an aqueous medium, and processing an aqueous medium containing the toner particles by gas bubbles.

* * * * *